US005183798A

United States Patent [19]

Sarraf et al.

[11] Patent Number: 5,183,798

[45] Date of Patent: Feb. 2, 1993

[54] MULTIPLE PASS LASER PRINTING FOR IMPROVED UNIFORMITY OF A TRANSFERRED IMAGE

[75] Inventors: Sanwal P. Sarraf; Sharon W. Weber, both of Webster; Hugh S. A. Gilmour, Rochester; Linda I. Ficcaglia, Geneva, all of N.Y.

[73] Assignee: Eastman Kodak Company, Rochester, N.Y.

[21] Appl. No.: 730,739

[22] Filed: Jul. 16, 1991

[51] Int. Cl.[5] ..... B41M 5/035; B41M 5/38

[52] U.S. Cl. ..... 503/227; 428/195; 428/913; 428/914; 430/200; 430/201; 430/945

[58] Field of Search ..... 8/471; 428/195, 913, 428/914; 430/200, 201, 945; 503/227

[56] References Cited

U.S. PATENT DOCUMENTS 4,833,124 5/1989 Lum ..... 503/227

*Primary Examiner*—B. Hamilton Hess

*Attorney, Agent, or Firm*—Harold E. Cole

[57] ABSTRACT

This invention relates to a process of forming a laser-induced thermal dye transfer image comprising:

a) contacting at least one dye-donor element comprising a support having thereon a dye layer, having an infra-red-absorbing material associated therewith, with a dye-receiving element comprising a support having thereon a polymeric dye image-receiving layer, said dye-donor and dye-receiver being separated by spacer beads;

b) imagewise-heating the dye-color element by means of a laser at a given power supplied to the laser; and c) transferring a dye image to the dye-receiving element to form the laser-induced thermal dye transfer image, and wherein another portion of the dye-donor element or another dye-donor element is imagewise-heated by the laser to transfer a second dye image which is approximately the same hue as the first dye image and is in register with the first dye image to produce a given density, the power supplied to the laser for the first and second imagewise heatings being lower than the power which would have to be supplied to the laser to produce the same given density with only one imagewise heating.

7 Claims, No Drawings

MULTIPLE PASS LASER PRINTING FOR IMPROVED UNIFORMITY OF A TRANSFERRED IMAGE

This invention relates to the use of multiple pass printing to improve the uniformity of a transferred image in a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated u p sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sep. 23, 1985, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Spacer beads are generally employed in a separate layer over the dye layer of the dye-donor in the above-described laser process in order to separate the dye-donor from the dye-receiver during dye transfer, thereby increasing the uniformity and density of the transferred image. That invention is more fully described in U.S. Pat. No. 4,772,582.

Alternatively, the spacer beads may be employed in the receiving layer of the dye-receiver as described in U.S. Pat. No. 4,876,235. The spacer beads may be coated with a polymeric binder if desired.

There is a problem with using spacer beads in the laser dye transfer system described above in that the beads hinder or prevent dye passage to the receiver. The beads also cause shadows to appear in the transferred image. When relatively large areas of uniform dye density are printed, a fine mottled appearance not unlike the "grain" of a photographic print is commonly observed. This is noticeable with a low power magnifier and results in laser thermal transparencies that show numerous white spots upon projection.

It would be desirable to provide a way to improve the uniformity of the dye image which is transferred by laser, thereby resulting in improved image uniformity.

U.S. Pat. No. 4,833,124 discloses the use of multiple pass printing in thermal head printing of transparencies in order to increase the density. There is no disclosure in that patent, however, that multiple pass printing may be used for laser printing in order to increase the uniformity of the transferred image.

Accordingly, this invention relates to a process of forming a laser-induced thermal dye transfer image comprising:

a) contacting at least one dye-donor element comprising a support having thereon a dye layer, having an infrared-absorbing material associated therewith, with a dye-receiving element comprising a support having thereon a polymeric dye image receiving layer, said dye-donor and dye-receiver being separated by spacer beads;

b) imagewise-heating the dye-donor element by means of a laser at a given power supplied to the laser; and c) transferring a dye image to the dye-receiving element to form the laser-induced thermal dye transfer image, and wherein another portion of the dye-donor element or another dye-donor element is imagewise-heated by the laser to transfer a second dye image which is approximately the same hue as the first dye image and is in register with the first dye image to produce a given density, the power supplied to the laser for the first and second imagewise heatings being lower than the power which would have to be supplied to the laser to produce the same given density with only one imagewise heating.

By use of the invention, substantially improved image uniformity is obtained. The pattern from the beads is minimized because the bead pattern is random and it is very improbable that a single bead position occurs in the same points for two separate dye-donors. There is also reduced visibility of the bead shadows since the contrast of the bead shadows is lowered relative to the background.

In general, it has been found that the largest improvement in uniformity is obtained with two passes. However, in some instances, three or more passes may be used. In each instance, the power supplied to the laser should be modulated in proportion to the number of times of the multiple pass printing.

If a certain desired density is obtained with one pass printing using a laser, then use of the invention enables one to obtain an image having approximately the same density, but with using multiple passes and lower power being supplied to the laser for each pass.

It is preferred to use a diode laser in the invention since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in DeBoer application Ser. No. 463,095, filed Jan. 10, 1990, or other materials as described in the following U.S. application Ser. No.: 366,970, 367,062, 366,967, 366,968, 366,969, 367,064, 367,061, 369,494, 366,952, 369,493, 369,492, and 369,491, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Spacer beads may be employed in a separate layer over the dye layer of the dye-donor in order to maintain the finite separation distance between the dye-donor and the dye-receiver during dye transfer. That invention is more fully described in U.S. Pat. No. 4,772,582, the disclosure of which is hereby incorporated by reference. The spacer beads may be coated with a polymeric binder if desired. Alternatively, the spacer beads may be employed in the receiving layer of the dye-receiver as described in U.S. Pat. No. 4,876,235, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

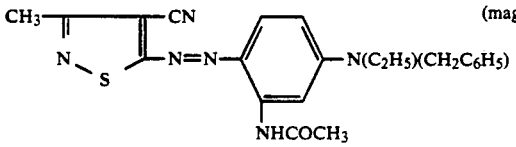

(magenta)

-continued

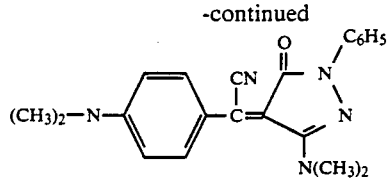

(magenta)

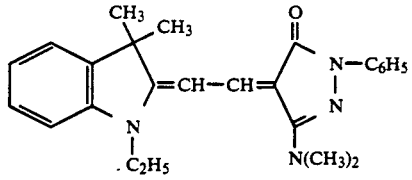

(yellow)

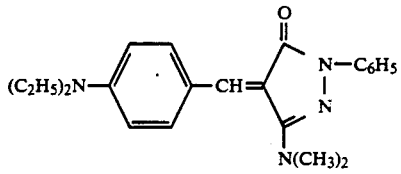

(yellow)

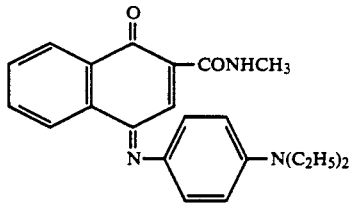

(cyan)

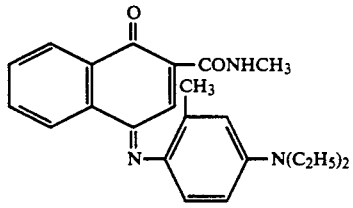

(cyan)

or any of the dyes disclosed in U.S. Pat. Nos. 4,541,830, 4,698,651, 4,695,287,4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 $g/m^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 um. It may also be coated with a subbing layer, if desired, such as those materials described in U. S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-coacrylonitrile), poly(caprolactone) or mixtures thereof. The dye image-receiving layer may be present in any amount which is effective for the intended purpose. In general, good results have been obtained at a concentration of from about 1 to about 5 g/m$^2$.

The following examples are provided to illustrate the invention.

EXAMPLE 1

Single Color Transfer

A) A magenta dye-donor element was prepared by coating the following layers on a 100 μm unsubbed poly(ethylene terephthalate) support:

1) Dye layer containing the magenta dyes illustrated above (each at 0.34 g/m$^2$), the infrared-absorbing dye A illustrated below (0.04 g/m$^2$) in a cellulose acetate propionate (2.5% acetyl, 46% propionyl) binder (0.34 g/m$^2$) coated from a 1-propanol and toluene solvent mixture; and
2) Overcoat-spacer layer of cross-linked poly(styrene-co-divinylbenzene) beads (90:10 ratio) (8 μm average diameter) (0.03 g/m$^2$), 10 G surfactant (a reaction product of nonylphenol and glycidol) (Olin Corp) (0.001 g/m$^2$) in a binder of Woodlok 40-0212 white glue (a water-based emulsion polymer of vinyl acetate (National Starch Co.) (0.03 g/m$^2$).

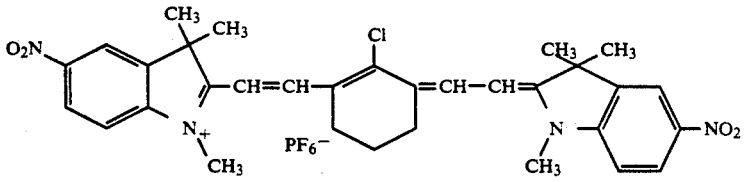

IR Absorbing Dye A

A dye-receiving element was prepared by coating the following layers in order on a 175 μm poly(ethylene terephthalate) support:

1) Subbing layer of poly(acrylonitrile-co-vinylidene chloride-co-acrylic acid) (14:79:7) (0.54 g/m$^2$) coated from butanone;
2) Receiving layer of Makrolon 5700® bisphenol-A polycarbonate (Bayer AG) (3.9 g/m$^2$), 1,4-didecoxy-2,5-dimethoxy benzene (0.52 g/m$^2$) and Fluorad FC-431® surfactant (3M Corp.) (0.008 g/m$^2$) coated from dichloromethane; and
3) Overcoat layer of Tone PCL-300® polycaprolactone (Union Carbide) (0.11 g/m$^2$), Fluorad FC-431® surfactant (3M Corp.) (0.01 g/m$^2$) and Dow Corning DC-510® surfactant (0.01 g/m$^2$) coated from dichloromethane.

Single color images were printed as described below from the dye-donor onto the receiver using a laser imaging device as described in U.S. Pat. No. 4,876,235. The laser imaging device consisted of a single diode laser connected to a lens assembly mounted on a translation stage and focused onto the dye-donor layer.

The dye-receiving element was secured to the drum of the diode laser imaging device with the receiving layer facing out. The dye-donor element was secured in face-to-face contact with the receiving element.

The diode laser used was a Spectra Diode Labs No. SDL-2430-H2, having an integral, attached optical fiber for the output of the laser beam, with a nominal wavelength of 816 nm and a nominal power output of milliwatts at the end of the optical fiber. The cleaved face of the optical fiber (100 microns core diameter) was imaged onto the plane of the dye-donor with a 0.33 magnification lens assembly mounted on a translation stage giving a nominal spot size of 33 microns and a measured power output at the focal plane of 115 milliwatts.

The drum, 312 mm in circumference, was rotated at 250 rpm and the imaging electronics were activated. The translation stage was incrementally advanced across the dye-donor by means of a lead screw turned by a microstepping motor, to give a center-to-center line distance of 20 microns (500 lines per centimeter). For a continuous tone stepped image, the current supplied to the laser was modulated from full power to 21% power in 5% increments.

The imaging electronics were activated and the modulated laser beam scanned the dye-donor to transfer dye to the dye-receiver.

For a single-pass transfer of dye, one dye-donor area was used. For a two-pass transfer of dye, the first dye-donor was separated from the receiver after the first graduated density image was produced, and a second dye-donor area was secured in face-to-face contact with the receiving element. The printing of the stepped image was then repeated. A three-pass transfer of dye repeated this process one more time. For multiple pass printing the power supplied to the laser was modulated to maintain equivalent densities.

After the laser had scanned approximately 12 mm, the laser exposing device was stopped, the receiver was separated and the dye was fused into the receiver polymer by heating with a 1200 watt hot-air blower for approximately 30 sec.

The Status A Green Transmission density of each stepped image was then read. Granularity measurements were obtained by reading the density of a large multiplicity (over a thousand) of non-overlapping areas with a 48 micron aperture to obtain an average density and then calculating by means of a computer the root mean square deviation from the mean density value. The following results were obtained:

| Number of Donor Passes | Status A Green Density | Relative Laser Power Each Pass | Sigma D Granularity |
|---|---|---|---|
| 1 | 0.51 | 70% | 22. |
| 2 | 0.53 | 58% | 14. |
| 3 | 0.55 | 51% | 14. |
| 1 | 0.66 | 73% | 28. |
| 2 | 0.69 | 63% | 20. |
| 3 | 0.65 | 54% | 19. |
| 1 | 0.97 | 81% | 49. |
| 2 | 0.93 | 69% | 22.* |
| 3 | 0.95 | 59% | 25.* |
| 1 | 1.20 | 98% | 63. |
| 2 | 1.29 | 84% | 42. |
| 3 | 1.20 | 64% | 27. |

*May be an artifact due to density variation of the samples.

The above data show the improvement in uniformity obtained, lower sigma D value, for laser-printing a given dye-density. The biggest relative improvement is shown with two-passes.

EXAMPLE 2

Multicolor Transfer

This example is similar to Example 1 but describes the improvement in image quality obtained when a neutral density image obtained from yellow, magenta, and cyan dye donors is printed using the method of the invention. Customarily in printing a multicolor image (represented by a neutral), each donor is printed once. When essentially the same image is obtained using multiple printing of the cyan and magenta image according to the invention, in the sequence cyan, magenta, yellow, cyan and magenta, an improvement in uniformity is observed.

Cyan dye-donor elements were prepared by coating the following layers on a 100 μm unsubbed poly(ethylene terephthalate) support:

1) Dye layer containing a mixture of the cyan dyes illustrated above (each at 0.67 g/m$^2$) and Regal 300 Carbon (Regal Carbon Co.) (0.18 g/m$^2$) ball-milled to sub-micron particle size in a cellulose acetate propionate binder (2.5% acetyl, 46% propionyl) (0.17 g/m$^2$) from dichloromethane
2) Overcoat spacer layer of cross-linked poly(styrene-codivinylbenzene) beads (90:10 ratio) (8 μm average diameter) (0.03 g/m$^2$), 10 G surfactant (a reaction product of nonylphenol and glycidol) (Olin Corp) (0.001 g/m$^2$) in a binder of Woodlok 40-0212 white glue (a water-based emulsion polymer of vinyl acetate (National Starch Co.) (0.03 g/m$^2$).

Magenta dye-donor elements were prepared as described above except using a mixture of the magenta dyes illustrated above (each at 0.34 g/m$^2$) and the binder level was adjusted (0.22 g/m$^2$).

Yellow dye-donor elements were prepared as described above except using a mixture of the yellow dyes illustrated above (each at 0.28 g/m$^2$) and the binder level was adjusted (0.13 g/m$^2$).

Dye receivers consisted of extruded sheets 2 mm thick of a mixture of bisphenol-A polycarbonate and poly(1,4-cyclohexylenedimethylene terephthalate) (50:50 mole ratio).

Neutral images were printed in sequence from individual cyan, magenta, and yellow dye donor sheets onto the same area of the receiver as described below using a laser imaging device similar to the one described in U.S. Ser. No. 457,595. The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage whose position was controlled by a lead screw which determined the y axis position of the image. The receiver was held tightly to the platen and the dye-donor element was held tightly to the receiver by means of vacuum grooves.

The laser beam had a wavelength of 830 nm and a power output of 37 mWatts at the platen. The measure spot size of the laser beam was an oval 7 by 9 microns (with the long dimension in the direction of the laser beam sweep). The center-to-center line distance was 12 microns (2120 lines per inch) with a laser scanning speed of 15 Hz. The test image consisted of a series of 16 steps of varying dye density each 5 mm×5 mm in area produced by modulating the current to the laser from full power to 16% power in variable increments.

The imaging electronics were activated and the modulated laser beam scanned the dye-donor to transfer dye to the receiver. For the invention, the stepped density neutral image was obtained by printing each step in the sequence: cyan, magenta, yellow, cyan, magenta. Cyan and magenta were thus printed twice from separate dye-donor sheets. For the control the sequence was cyan, magenta, and yellow; each dye was only printed once. The power supplied to the laser was adjusted for each printing to maintain proper density values for the neutral image.

After imaging the receiver was removed from the platen and the dyes were fused into the receiving polymer by heating with a 1200 watt hot-air blower. The surface of the receiver was heated for approximately 15 sec.

Each image was projected to approximately 25 times magnification for evaluation of how well the density differences between the spacer beads and background were minimized. For the control the greatest density differences (apparent non-uniformities due to bead shadows) were observed at the steps of moderate density, although these density differences could be observed at all steps. The visual density differences (apparent non-uniformities due to bead shadows were substantially diminished in all the steps of equivalent density produced by the multipass printing process of the invention. Severe bead shadows were observed upon projection in all steps of the control; almost no bead shadows were visible in the high-density steps and few bead shadows were visible in the mid-density and low-density steps of the image produced by the multipass invention process.

The Status A Red, Green, and Blue reflection densities were also read for each step. The results are tabulated below:

| Procedure * | Laser Power-mWatts (full power = 37 mWatt) | Status A Density* R/G/B | Bead Shadows |
|---|---|---|---|
| Invention | 31/25/31/31/25 | 2.8/2.9/2.8 | None |
| Control | 37/37/37 | 2.2/2.8/3.0 | Severe |
| Invention | 26/20/24/26/20 | 2.0/2.1/2.0 | None |
| Control | 37/31/27 | 2.0/2.0/2.3 | Severe |
| Invention | 23/17/21/23/17 | 1.7/1.8/1.7 | Few |
| Control | 33/28/24 | 1.7/1.7/1.8 | Severe |
| Invention | 20/14/16/20/14 | 1.2/1.1/1.1 | Few |
| Control | 27/22/18/27/22 | 1.0/1.1/1.3 | Severe |
| Invention | 13/9/9/13/9 | 0.5/0.5/0.5 | Few |
| Control | 20/14/10 | 0.5/0.5/0.6 | Severe |
| Invention | 9/7/6/9/7 | 0.2/0.2/0.2 | Few |
| Control | 10/8/6 | 0.2/0.2/0.2 | Severe |

*Printing sequence is C, M, Y, C, M for the invention and C, M, Y for the control. Relative laser power for each individual donor printing is given and measured combined densities produced on receiver are given.

The invention has been described in detail with particular reference to preferred embodiments thereof, but it will be understood that variations and modifications can be effected within the spirit and scope of the invention.

What is claimed is:

1. In a process of forming a laser-induced thermal dye transfer image comprising:

a) contacting at least one dye-donor element comprising a support having thereon a dye layer, having an infrared-absorbing material associated therewith, with a dye-receiving element comprising a support having thereon a polymeric dye image-receiving layer, said dye-donor and dye-receiver being separated by spacer beads;

b) imagewise-heating said dye-donor element by means of a laser at a given power supplied to the laser; and c) transferring a dye image to said dye-receiving element to form said laser-induced thermal dye transfer image, the improvement wherein another portion of said dye-donor element or another dye-donor element is imagewise-heated by said laser to transfer a second dye image which is approximately the same hue as said first dye image and is in register with said first dye image to produce a given density, the power supplied to said laser for said first and second imagewise heatings being lower than the power which would have to be supplied to said laser to produce the same given density with only one imagewise heating.

2. The process of claim 1 wherein said spacer beads are employed in the dye-receiving layer of said dye-receiver.

3. The process of claim 1 wherein said spacer beads are employed in an overcoat of said dye-donor element.

4. The process of claim 1 wherein said infrared-absorbing material is an infrared-absorbing dye.

5. The process of claim 1 wherein said laser is a diode laser.

6. The process of claim 1 wherein said support for said dye-receiving element is a transparent film.

7. The process of claim 1 wherein a multicolor image is obtained by using the following sequence of dye transfer images: cyan dye transfer image, magenta dye transfer image, yellow dye transfer image, cyan dye transfer image and magenta dye transfer image.

* * * * *